US006241045B1

(12) United States Patent
Reeve et al.

(10) Patent No.: US 6,241,045 B1
(45) Date of Patent: Jun. 5, 2001

(54) SAFETY STRUCTURES FOR POLE CLIMBING APPLICATIONS

(75) Inventors: Robert E. Reeve, Bristol, CT (US); Steven E. Reeve, 1041 Dublin Rd., Columbus, OH (US) 43212

(73) Assignee: Steven E. Reeve, Columbus, OH (US)

( * ) Notice: Subject to any disclaimer, the term of this patent is extended or adjusted under 35 U.S.C. 154(b) by 0 days.

(21) Appl. No.: 09/439,926

(22) Filed: Nov. 12, 1999

Related U.S. Application Data

(63) Continuation of application No. 09/083,534, filed on May 22, 1998, now abandoned.

(51) Int. Cl.[7] ..... E06C 7/18
(52) U.S. Cl. ..... 182/9; 182/133
(58) Field of Search ..... 182/9, 3, 142, 182/133; 248/289.11, 125.7, 230.5

(56) References Cited

U.S. PATENT DOCUMENTS 3,647,171 * 3/1972 Rafferty ..... 182/9
5,603,389 * 2/1997 Zemon ..... 182/133
6,016,889 * 1/2000 Pearcy ..... 182/9

* cited by examiner

*Primary Examiner*—Alvin Chin-Shue
(74) *Attorney, Agent, or Firm*—Sean M. Casey; Paul R. Miller

(57) ABSTRACT

A novel fall protection apparatus is described wherein a worker can climb a pole, while maneuvering about the pole as he climbs. This structure enables the worker to both ascend and descend, but be protected upon an accidental fall from the pole. In particular, the arrangement prevents the worker from falling more than a couple of feet, and at the same time holds the worker away from the pole by an amount sufficient to prevent injuries caused by banging into the pole. This structure is especially beneficial in training new workers to climb poles for work, as well as requalifying previously trained workers.

13 Claims, 3 Drawing Sheets

FIG. 1
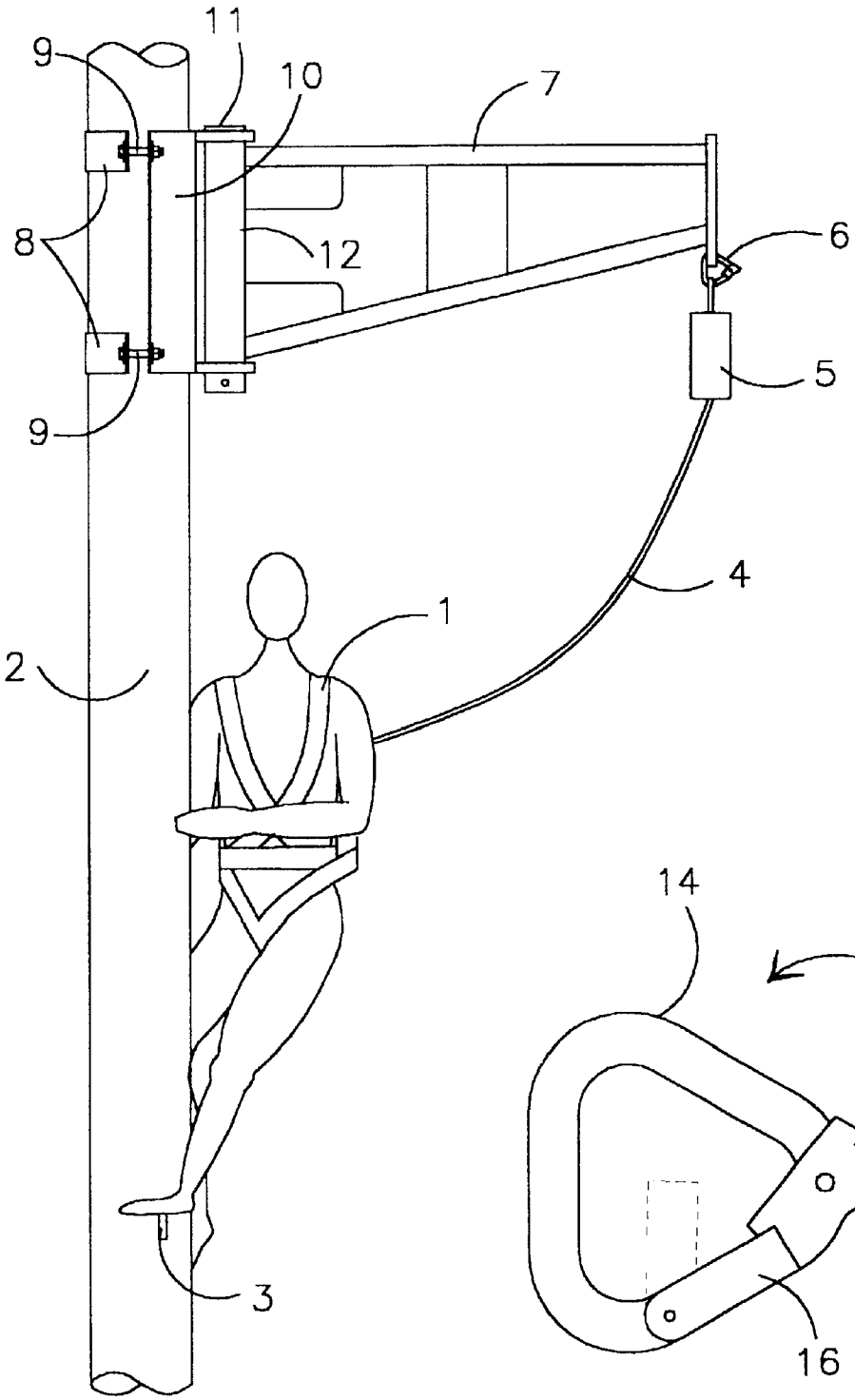
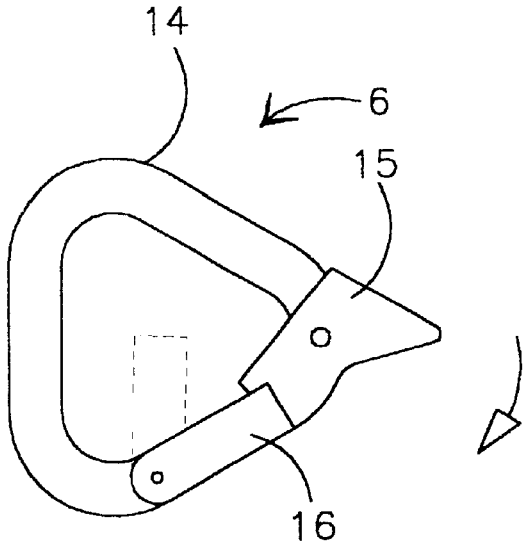
FIG. 4

SAFETY STRUCTURES FOR POLE CLIMBING APPLICATIONS

This application is a continuation of U.S. patent application Ser. No. 09/083,534 filed May 22, 1998, now abandoned.

The present invention is directed to a fall protection, life-saving feature for workers climbing poles, whether they are of a telephone pole type, a lamp pole type, or any type of pole that a workman needs to climb. In particular, the present invention involves a structure to enable a worker to move in rotation about the pole, as he/she climbs or works, and still maintain a safety feature to prevent any potential or accidental falling off of the pole structure. Particularly, the structure of the present invention provides safety features especially while training new workers to climb and work on such poles, or requalifying previously trained pole climbers.

BACKGROUND OF THE INVENTION

Structures enabling people to climb various types of poles for different reasons have been known for some time. For example, various arrangements for climbing poles may be seen in U.S. Pat. Nos. 3,968,858; 4,527,660; and 5,050,704. These various patents all relate to ways of climbing poles of different types to perform work, each using some sort of safety line for maintaining the person on the pole. All of these prior art type arrangements, however, fail to allow the worker to work around the pole unless he were to dismount the pole and start over again at a different spot.

Further in this vein, an even more difficult arrangement to work around the pole may be seen in U.S. Pat. No. 3,957,135. This more complicated device involves a cage mounted to the pole for carrying a worker up the pole. Again, while a safety line is present, the worker cannot move the cage about the pole as he works or climbs.

Finally, in the patent to Kleveborn, U.S. Pat. No. 4,572,329 a structure is provided for climbing a rail-type pole having a U-shaped runner to which a line is attached. The difficulty with this type of prior art arrangement is the use of stepping shoe plates mounted on runners fitted to the rail to move upwardly, as the worker moves his feet. Also, this prior art type arrangement uses a rail-like member on which the climbing structure is mounted, rather than having a cylindrical-like pole structure like that used throughout the world.

SUMMARY OF THE INVENTION

The present invention is directed to a pole climbing feature in which a worker may move around the pole while climbing, yet be securely fixed in the event of a fall from the pole.

In particular, the present invention relates to use on a cylindrical type pole, which is the norm in almost all such structures worldwide. A novel clamping frame is provided according to the present invention to be mounted at any height on the pole. This clamping frame can be used with any sized cylindrical pole, having a wide range of pole diameters.

Also, the clamping frame of the present invention further includes a rotating arm connected to it which arm can be rotated at least partially about the pole. A holding structure is fixed, according to the present invention, to the end of the rotating arm away from the pole, and a life line structure is fixed and constructed in accordance with the present invention to this holding structure.

According to the present invention, the clamping frame is a structure to enable connection to a pole having a wide range of diameters. It is especially useful with construction type and utility type poles, which may have diameters ranging from about 6 to 10 inches.

The rotating arm of the present invention is preferably attached to the clamping frame by way of a pivoting arrangement used in fixing the rotating arm to the clamping frame. Such a pivoting arrangement allows rotation of the rotating arm about the pole.

In accordance with the present invention, the rotating arm, fixed to the pole through the clamping frame, may rotate about the pole in any desired amount of rotation. Such rotation may be up to at least about 250 degrees. Thus, a worker is able to climb the pole in at least a partially circular manner, instead of just straight up.

Further, the rotating arm is formed of a frame structure sufficient to bear significant forces at the end of the arm by the life line structure acting on the holding structure. It is constructed of a galvanized tubing fixed to steel flat members to absorb such forces. These forces are also absorbed in the pivoting arrangement which is part of the rotating arm fixed to the clamping frame.

The life line structure is fixed to an anchoring structure at the end of the rotating arm by way of a self-locking link member, such as a caribiner. This life line structure of the present invention connects a safety line to a climber on the pole, so that a self-locking device is activated locking the safety line, if the climber falls accidentally from the pole. The climber is quickly held immediately after a short fall of only at most a couple of feet, if not quicker. Moreover, because the life line is fixed at the end of the rotating arm away from the pole, the fall of the worker does not entail falling into or against the pole, causing injury or the receipt of splinters in the case of wooden poles.

A worker is prevented from falling more than a couple of feet during an accidental fall because the safety line is held through the life line structure fixed to the self-locking structure of the present invention. This unique arrangement enables the safety line to be reeled-in slowly, as the climber climbs, or be pulled out slowly, as the climber descends the pole. Upon a fall of the climber from the pole, the resulting yanking pull causes the self-locking mechanism, for example, an inertial device, to lock-up a take-up reel, so that a further pulling out of the safety line is impossible. The climber is prevented from falling more than a couple of feet, and ideally, the present invention may be designed to result in a fall of only a foot or so.

Upon slipping from the pole, the climber falls only about a foot or so, and then his fall is arrested in mid-air without his falling to the ground and receiving serious injuries. Further, since the safety line is stopped and held at a position away from the pole by the rotating arm, then he is prevented from falling against the pole. Serious injuries by way of bruises and cuts from impact on the pole are avoided.

The safety features of the present invention become very important in training workers to climb poles without receiving serious injuries. A problem of fear of falling that may occur to persons being trained to climb poles, or being retrained for such jobs, is significantly reduced by the present invention, thereby reducing possible employee termination.

BRIEF DESCRIPTION OF THE DRAWING FIGURES

The features of the present invention will be described with reference to the drawing figures which show without limitation the features and structure of the present invention, wherein:

FIG. 1 shows in general form the constructional features for the present invention and their use;

Figure 2:
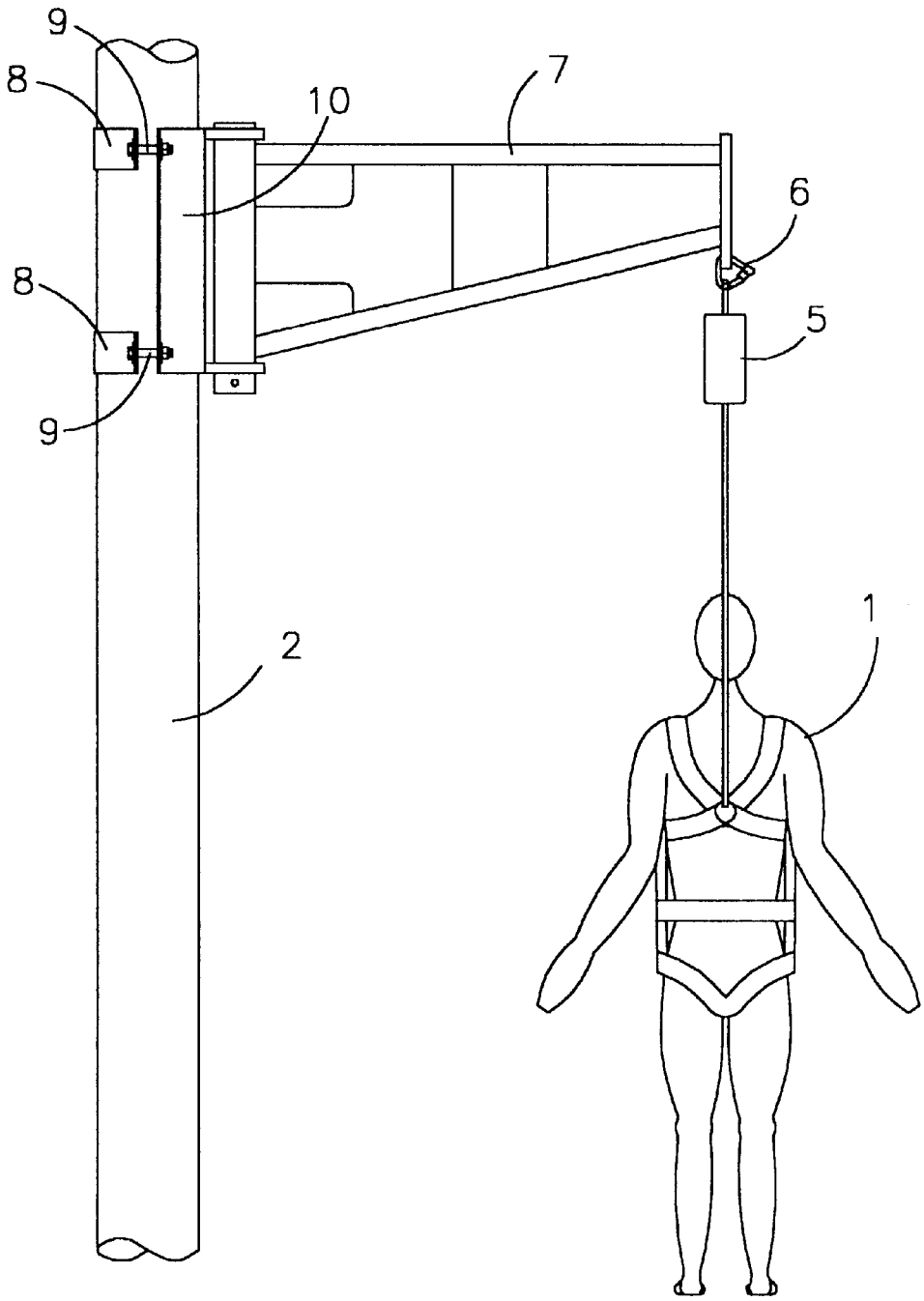
FIG. 2 is a showing of a worker falling away from the pole but being prevented from falling to the ground, or banging against the pole, according to the present invention.
Figure 3E:
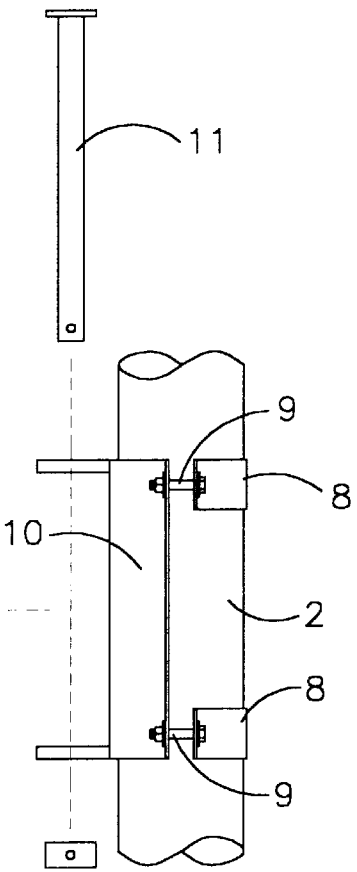
Figure 3C:
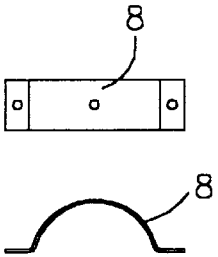
Figure 3D:
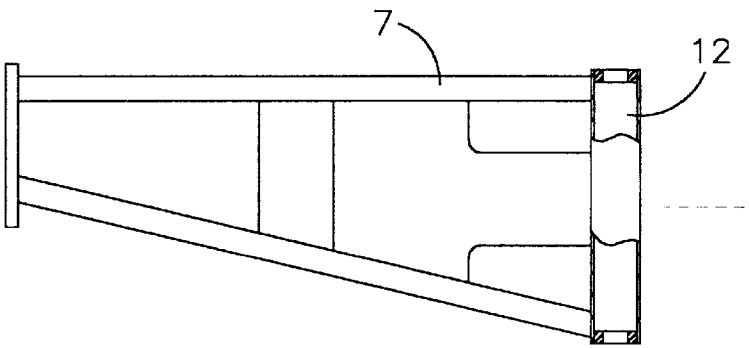
Figure 3B:
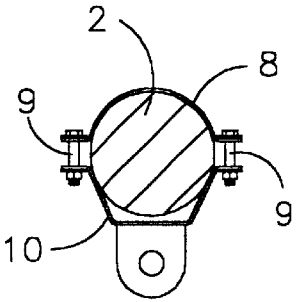
Figure 3A:
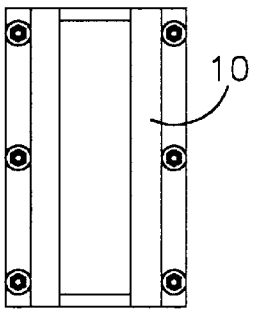

FIGS. 3*a*, 3*b*, 3*c*, 3*d*, and 3*e* show various view of the construction and structure of the rotating arm of the present invention; and FIG. 4 shows a self-locking link used in accordance with the present invention to hold the safety line structure to the end of the rotating arm.

DETAILED DESCRIPTION OF THE INVENTION

The present invention involves a novel arrangement for climbing poles, such as may be seen in FIG. 1. Here a person 1 is climbing a pole 2, particularly of a cylindrical type, using gaffs or climbing spurs 3, which are typically mounted on telephone poles, for example. The person, such as a worker or climber, 1 mounting the pole is further held by way of a safety line 4 which is fed from a life line structure 5.

This life line structure or apparatus is mounted by an anchoring structure, such as a self-locking link, or caribiner, 6, seen in FIG. 4, at the end of a rotating arm 7 mounted on the pole 2. The rotating arm 7 is fixed on the pole 2 by way of two collars or buckles 8. These buckles 8 are attached to a member, such as a pole mounting bracket 10, to the pole by way of fasteners 9, such as bolts.

This construction may be further seen in the partially separated or broken-away forms as seen in FIGS. 3*a*, 3*b*, 3*c*, 3*d*, and 3*e*. Here, a mounting bracket 10 for mounting the assembly on the pole is fixed to the pole 2 by connecting the two buckles 8 to the mounting bracket 10 with the bolts 9, as variously seen in FIG. 3. Upon fitting a bolt pin 11 through openings at the top and bottom of the mounting bracket, and through the tube-like part 12 of the rotating arm 7, the arm 7 is fixed for rotation about the pole 2. The rotating arm 7 is then able to rotate about the pin 11 fixed through the structure 12 in either direction about the pole in an amount of at least 250 degrees. This allows the person, or worker, 1 who is climbing the pole 2 to move around the pole in at least a circular motion.

In operation, the climber or worker 1 connects or hooks the safety line 4 to a body harness that he wears during the climb. He then begins to ascend the pole 2, using the climbing spurs 3, and the safety line retracts smoothly into the life-line structure 5. As he climbs, the worker 1 is able to go around the pole as needed, according to the location of the various climbing spurs. In the event of a slip or accidental fall from the pole, the worker or trainee is swung out away from the pole by the safety line, and the sudden jerking on the line caused by the fall causes the life-line structure 5 to lock the line 4 in position, so that at most a fall of only a couple of feet occurs. Also, because the worker 1 is pulled out away from the pole 2 by the line 4 at the end of the rotating arm 7 he does not receive any injury by striking the pole.

The rotating arm 7 is constructed of a length sufficient to maintain the safety line away from the pole. This length is sufficient so that the person 1 on the safety line 4 will not strike the pole. An example of the length of the rotating arm is at least several feet. One embodiment of the present invention involves a structure where the rotating arm is approximately 36 inches, or three feet from the pole center. However, the length of the rotating arm is made so that a trainee falling from the pole is still able to reach back to the pole or climbing spurs and pull himself back to the pole.

FIG. 4 illustrates the self-locking link 14 used in the present invention to connect the life line structure 5 to the rotating arm 7. This link 14 includes a trigger 14 to open the link by moving the link member 16 inwardly, as shown in phantom in FIG. 4. The link member 16 is spring loaded in order to spring backward to a closed position after opening. The trigger 14 being depressed pushes against the spring to release and open the link member, so that it can be mounted on the rotating arm 7 to hold the life line structure 5.

This safety structure provided by the present invention can be used with different sized poles. For example, telephone poles having a diameter ranging from about 7 to 9 inches are easily handled by the inventive structure. With larger diameter poles, then an enlarged version of the bracket 10 and buckles 8 could be easily provided for use.

Moreover, the apparatus of the present invention has been successfully tested to withstand static forces in excess of five thousand pounds without any breakage in the system. Also, the structures of the rotating arm 7 and its mounting fixtures may be furnished with a painted finish, a coated finish, a dielectric coating, a plated finish, or a galvanized coating. Such galvanized coating, which is a preferred embodiment, may be prepared for a hot dip galvanizing process by way of special manufacturing and assembly procedures. These procedures may include galvanizing arm and fastening members, such as the mounting bracket 10, without the shaft or pivoting pin 11, which enables rotation of the arm7. The shaft or pin 11 is then assembled with the arm and mounting bracket, after such galvanizing, to be assembled on the pole 2 after the process is complete.

While a preferred embodiment of the present invention has been disclosed in this application, all modification and change of the invention which are evident to those of skill in the art are intended to be included in this application, and the coverage given to this invention is limited only by way of the claims and all equivalents thereto.

What is claimed:

1. An anchoring apparatus for fall protection during climbing of a vertically extending structure, comprising:

a releasable and adjustable mounting structure that includes a pair of spaced collars adjustable attached by fasteners to a mounting bracket that includes a pair of mounting flanges, said collars adapted to adjustably clamp the bracket to the vertically extending structure;

an arm having at one end a tubular portion that is rotatably attached with a pin assemblv to the mounting bracket between the flanges; and a safety line extending from the other end of said arm.

2. An apparatus according to claim 1, wherein said safety line is fixed to said arm through means for reversibly reeling said safety line inwardly and outwardly.

3. An apparatus according to claim 2, wherein said means moves said safety line smoothly when pulled slowly, and abruptly stops said safety line when pulled suddenly.

4. An apparatus according to claim 1, wherein said arm swings about said bracket for up to 250 degrees.

5. An apparatus according to claim 1, wherein said arm extends for a length from said bracket to said end.

6. An apparatus according to claim 5, wherin said length is about 36 inches.

7. An apparatus according to claim 1, wherein said safety line connects to a means for reversibly reeling said safety line smoothly inwardly and outwardly, and includes a locking means for preventing rapid release of said line when pulled suddenly.

8. An apparatus according to claim 7, wherein said safety line is attached to said arm at a distance from said bracket.

9. An apparatus according to claim 8, wherein said distance is sufficient to prevent said worker from striking said vertically extending structure in the event of a fall.

10. A vertical utility pole mounted device for preventing accidental falls of a utility worker during ascent, utility maintenance, and descent of the pole, comprising:

a releasable and adjustable mounting structure that includes a pair of spaced collars adjustable attached by fasteners to a mounting bracket that includes a pair of mountings flanges, said collars adapted to adjustable clamp the bracket to the utility pole;

an arm member depending from and rotatably mounted to the mounting structure to rotate about a portion of a full circular range of motion and having at one end a tubular portion that is rotatably attached to the mounting bracket between the flanges with a pin; and a holding structure attached to an end of thc arm membcr and that includes a life line structure with a deployable and retractable safety line, the life line structure further incorporating a locking link member connecting the safety line to the life line structure and operative to prevent the accidental fall of the utility worker.

11. A fall prevention device mountable to a vertically projecting utility pole for preventing the accidental fall of a utility worker engaged in maintaining utilities on the pole, comprising:

a releasable and adjustable mounting structure that includes a pair of spaced collars adjustably attached by fasteners to a mounting bracket that includes a pair of mounting flanges, said collars adapted to adjustably clamp the bracket to the utility pole;

an arm member mounted to the mounting structure and having at one end a tubular portion that is rotatably attached to the mounting bracket between the flanges with a pin and which is operative to rotate through a segment of a 360 degree range of motion; and a holding structure attached to an end of the arm member that includes a life line structure having a locking link connecting a deployable and retractable safety line to the life line structure.

12. An apparatus for preventing accidental fall of a worker maintaining utilities on a utility pole having a variable diameter along a vertical axis, comprising:

an adjustably and releasably mounted frame structure, adapted to mount at any point about the vertical axis of the pole, that includes a pair of spaced collars adiustably attached by fasteners to a mounting bracket that includes a pair of mounting flanges, said collars adapted to adiustably clamp the bracket to the utility pole;

an arm member mounted with a pin assembly to the frame structure to rotatably project outwardly from the pole and including a distal end and having at the other end a tubular portion that is rotatably attached to the mounting bracket between the flanges with the pin assembly; and a holding structure mounted to the distal end and which incorporates a life line structure configured with a deployable and retractable safety line adapted to prevent the rapid deployment of the safety line and protect the worker from an accidental fall.

13. An apparatus according to claim 12 wherein the arm member is rotatable through a range of motion that is approximately 250 degrees of a full circular range of motion.

* * * * *